US009787000B2

(12) United States Patent
Kim et al.

(10) Patent No.: US 9,787,000 B2
(45) Date of Patent: Oct. 10, 2017

(54) BEAMFORMING ARRAY ANTENNA CONTROL SYSTEM AND METHOD FOR BEAMFORMING USING THE SAME

(71) Applicant: KOREA ELECTRONICS TECHNOLOGY INSTITUTE, Seongnam-si, Gyeonggi-do (KR)

(72) Inventors: Ki Jin Kim, Gwangju-si (KR); Kwang Ho Ahn, Yongin-si (KR); Sanghoon Park, Seoul (KR); Jong-Won Yu, Daejeon (KR); Hyun Sung Tae, Daejeon (KR)

(73) Assignee: KOREA ELECTRONICS TECHNOLOGY INSTITUTE, Seongnam-si, Gyeonggi-Do (KR)

( * ) Notice: Subject to any disclaimer, the term of this patent is extended or adjusted under 35 U.S.C. 154(b) by 290 days.

(21) Appl. No.: 14/630,267

(22) Filed: Feb. 24, 2015

(65) Prior Publication Data

US 2015/0229034 A1 Aug. 13, 2015

Related U.S. Application Data

(62) Division of application No. 13/325,591, filed on Dec. 14, 2011, now Pat. No. 9,000,981.

(30) Foreign Application Priority Data

Dec. 24, 2010 (KR) ..... 10-2010-0134875

(51) Int. Cl.

| | |
|---|---|
| ***H01Q 3/00*** | (2006.01) |
| ***H01Q 3/12*** | (2006.01) |
| ***H01Q 25/00*** | (2006.01) |

(52) U.S. Cl.
CPC ..... *H01Q 25/00* (2013.01); *H01Q 3/00* (2013.01)

(58) Field of Classification Search
CPC ..... H01C 3/40; H01C 25/002
USPC ..... 342/81, 154, 368, 373, 374; 367/61; 706/24
See application file for complete search history.

(56) References Cited

U.S. PATENT DOCUMENTS

| | | | | |
|---|---|---|---|---|
| 2002/0146983 | A1* | 10/2002 | Scherzer | H04W 24/02 455/67.11 |
| 2004/0235527 | A1* | 11/2004 | Reudink | H04B 7/0491 455/561 |
| 2006/0007890 | A1* | 1/2006 | Yokoyama | H04B 7/086 370/334 |

FOREIGN PATENT DOCUMENTS

| | | |
|---|---|---|
| KR | 1020080020585 | 3/2008 |
| KR | 1020100122077 | 11/2010 |

* cited by examiner

*Primary Examiner* — Dao Phan
(74) *Attorney, Agent, or Firm* — Hauptman Ham, LLP

(57) ABSTRACT

A control system connected to a plurality of array antenna performs beamforming. The control system comprises a beam radiation controller for requesting a predetermined first antenna group to radiate beams and requesting a second antenna group including the first antenna group to radiate beams to an optimized sector, a beam receiver for receiving response beams from the first antenna group and the second antenna group, and a sector selector for setting up an optimized sector based on the received beams for the first antenna group, and transmitting information on the optimized sector to the beam radiation controller in order to control the second antenna group to radiate beams to the optimized sector.

3 Claims, 11 Drawing Sheets

BEAMFORMING ARRAY ANTENNA CONTROL SYSTEM AND METHOD FOR BEAMFORMING USING THE SAME

CROSS REFERENCE TO RELATED APPLICATION

This application is a divisional of patent application Ser. No. 13/325,591, filed on Dec. 14, 2011 which claims priority of Korean Patent Application No. 10-2010-0134875 filed on Dec. 24, 2010, the entire contents of which are incorporated herein by reference.

BACKGROUND OF THE INVENTION (a) Field of the Invention

The present invention relates a beamforming array antenna control system and a method for beamforming using the same.

(b) Description of the Related Art

Lately, various near field communication technologies have been actively developed. Among them, a near field communication using a 60 GHz band has been receiving greater attention due to advantages of a 60 GHz band. Although 60 GHz band has great atmospheric attenuation, 60 GHz band has a high frequency reuse factor and a high collimation factor. A related communication protocol for a high speed data transmission, for example, about 1 Gbps or faster, has been defined in order to high speed Internet access, for example, high speed streaming of a high definition television (HDTV) and a home theater.

In a typical beamforming network supporting such a communication protocol, a beam direction is controlled by controlling an input phase of each antenna, which inputs through a parallel feed antenna, using a phase shifter. In a different beamforming network, an output beam direction may be controlled according to an input port using a hybrid coupler and a phase delay or by using only a phase delay.

Such a typical beamforming network structure can control an output beam direction but have a complicated structure. Accordingly, it is difficult to realize the typical beamforming network at high frequency. Furthermore, since a comparatively long time is required in beamforming communication and a beam angle cannot be controlled in the typical beamforming network, the typical beamforming network is not proper for communication through precise beamforming.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a beamforming array antenna control system and a method for beamforming using the same having advantages of shortening a search time.

An exemplary embodiment of the present invention provides a method for beamforming at a control system connected to a plurality of array antennas.

The method includes requesting a first antenna group to radiate beams to a plurality of predetermined sectors, wherein the first antenna group is predetermined from the plurality of array antennas, receiving response beams inputting to the first antenna group in response to the radiated beams, selecting a sector related to a response beam having a comparatively stronger intensity from the plurality of predetermined sectors, and deciding the selected sector as an optimized sector, setting up the first antenna group and a plurality of antennas adjacent to the first antenna group as a second antenna group, and requesting the second antenna group to radiate beams to a plurality of sectors in the optimized sector, receiving response beams inputting to the second antenna group in response to the radiated beams, selecting a sector related to a response beam having a comparatively stronger intensity from the plurality of sectors in the optimized sector, and deciding the selected sector as a final sector, deciding a plurality of beam levels through beam level training to the final sector; and deciding a final beam signal pair from the plurality of decided beam levels through high resolution (HRS) beam training to the final sector.

Another embodiment of the present invention provides a control system for controlling beamforming by being connected to a plurality of array antennas.

The control system include a beam radiation controller for requesting a predetermined first antenna group to radiate beams and requesting a second antenna group including the first antenna group to radiate beams to an optimized sector, a beam receiver for receiving response beams from the first antenna group and the second antenna group, and a sector selector for setting up an optimized sector based on the received beams for the first antenna group, and transmitting information on the optimized sector to the beam radiation controller in order to control the second antenna group to radiate beams to the optimized sector.

According to an exemplary embodiment of the present invention, a beam protocol is satisfied because beamforming communication is performed by controlling the number of arrays of antenna, and a search time is shorted by quickly and precisely searching for a target.

DETAILED DESCRIPTION OF THE EMBODIMENTS

Figure 1:
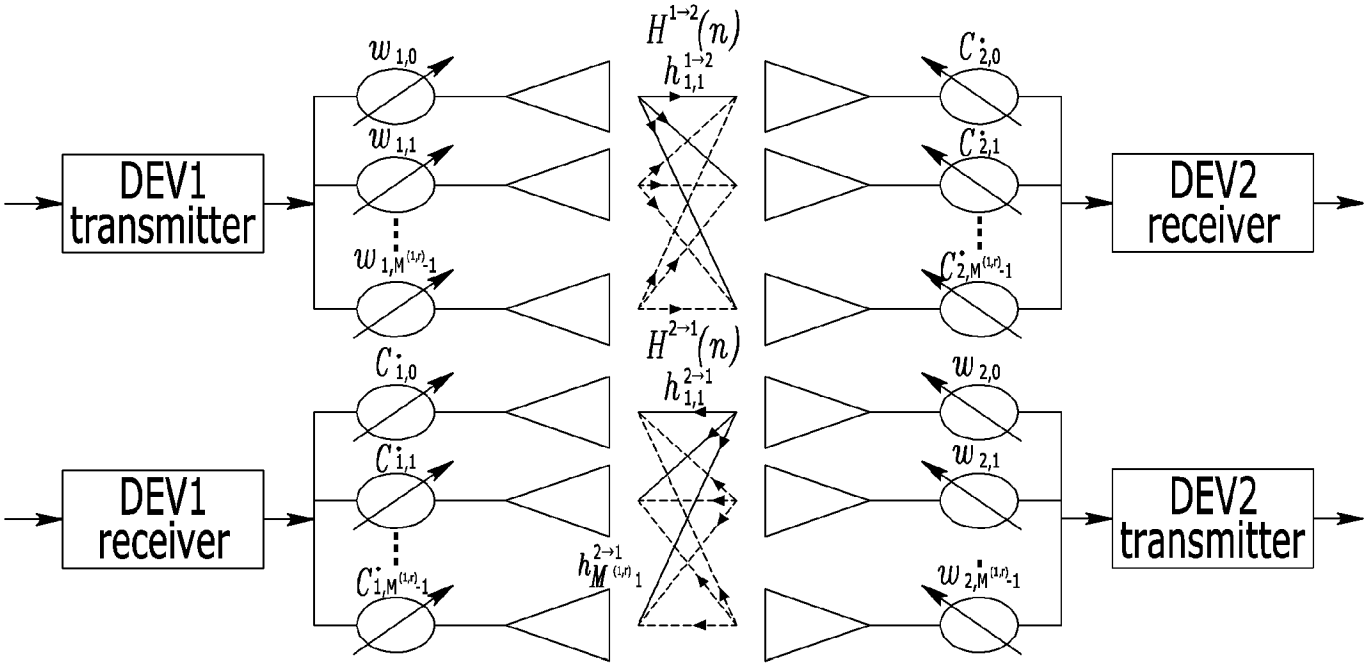
FIG. 1 is a perspective view of a typical beamforming antenna.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Through the specification, unless explicitly described to the contrary, the word "comprise" and variations such as "comprises" or "comprising", will be understood to imply the inclusion of stated elements but not the exclusion of any other elements.

Hereinafter, a beamforming array antenna and a beamforming method using the same will be described with reference to the accompanying drawing. Prior to describing an exemplary embodiment of the present invention, a typical beamforming antenna and a beamforming protocol will be described.

FIG. 1 is a perspective view of a typical beamforming antenna.

As shown in FIG. 1, a typical beamforming antenna decides a beam direction and a beam intensity of a beam based on a beam former vector ($\mathcal{W}$ i,j) of a transmitter and a combiner vector ($\mathcal{C}$ i,j) of a receiver. Furthermore, the beam direction and the beam intensity of the beam may be expressed by a channel state information matrix $_{(CSI)}h^{1-2}_{i,j}$, which is transmitted through a Multi input Multi output (MIMO) channel.

As described above, the typical beamforming antenna decides the beam direction and the beam intensity based on a beamforming vector, a combiner vector, and a CSI matrix. Such a typical beamforming antenna fines an optimized beam signal pair through beam signal search between a transmitter and a receiver. Accordingly, a comparatively long time is consumed to calculate all CSI matrices for beamforming communication.

A typical beamforming protocol using a typical beamforming antenna will be described with reference to FIG. 2A to FIG. 2D.

FIG. 2A to FIG. 2D illustrate a beamforming protocol using a typical beamforming antenna.

Figure 2A:
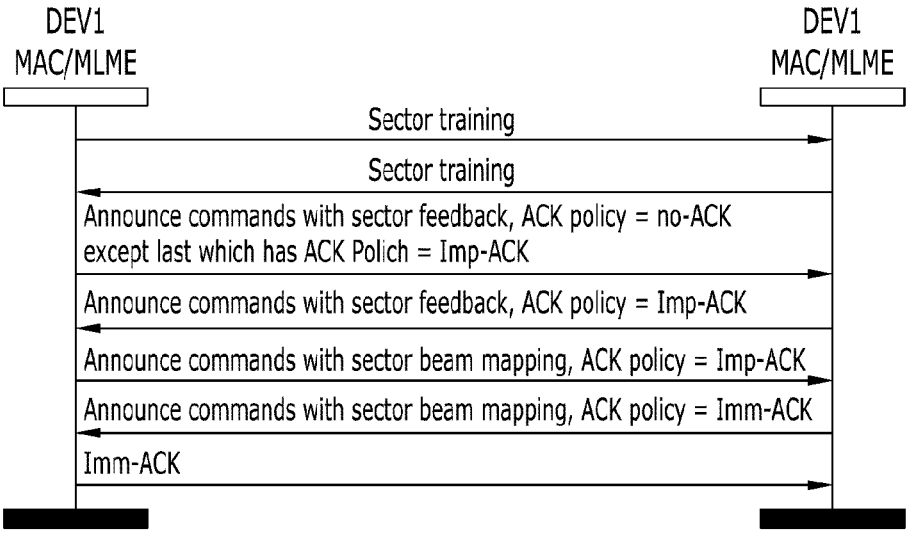
FIG. 2A to FIG. 2D illustrate a beamforming protocol using a typical beamforming antenna.

When beamforming communication initiates, beam searching is performed within a predetermined range through sector level training as shown in FIG. 2A. That is, a transmitting antenna and a receiving antenna decide an optimized sector for a beam by performing beam searching through mutual sector training. Since the procedures of FIG. 2B to FIG. 2D including FIG. 2A are already widely known, the detailed description thereof will be omitted in an exemplary embodiment of the present invention.

Figure 2B:
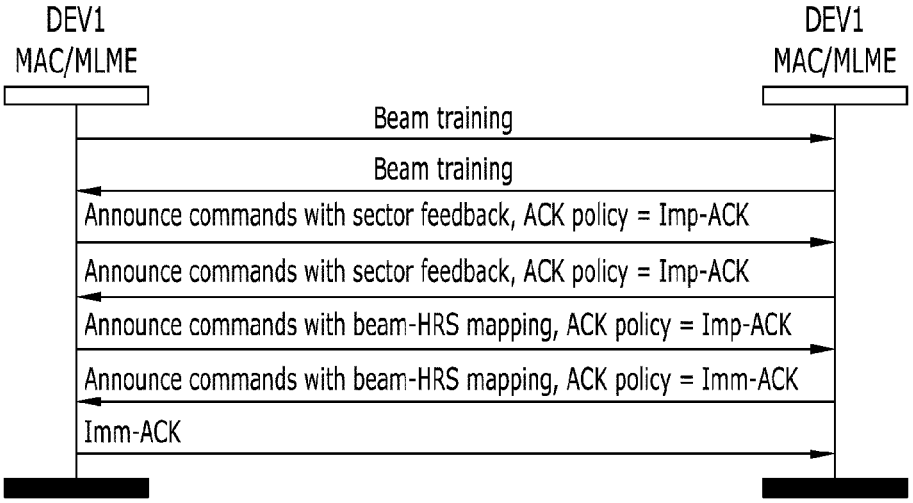
Figure 2C:
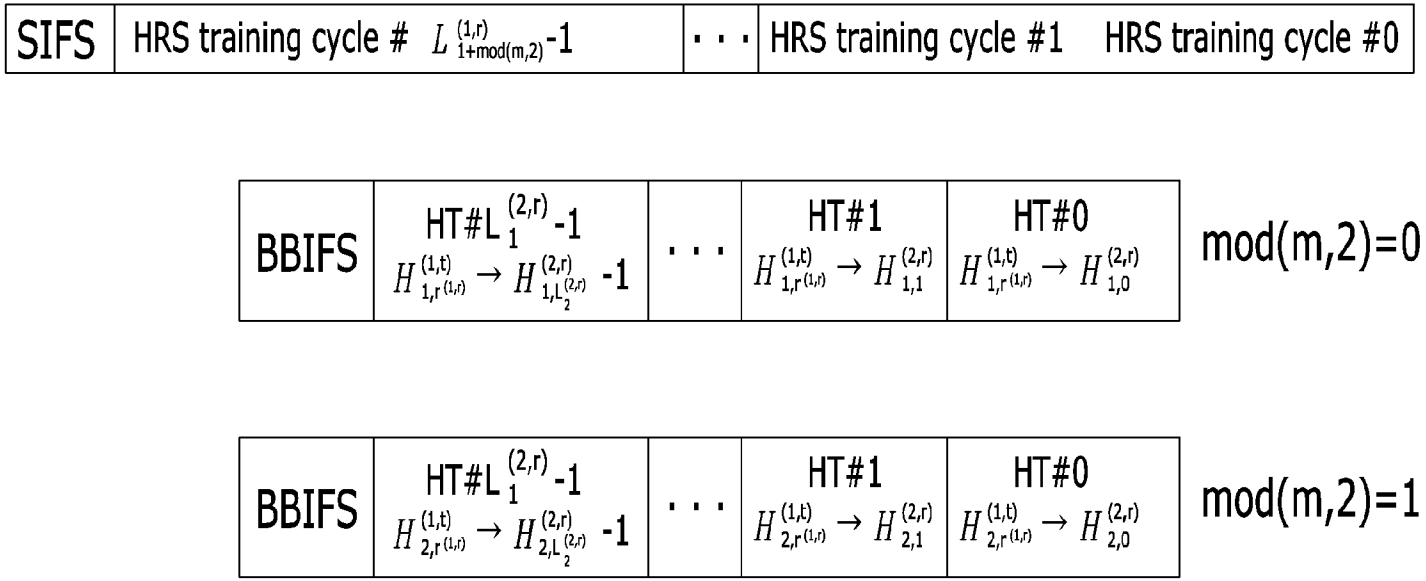
Figure 2D:
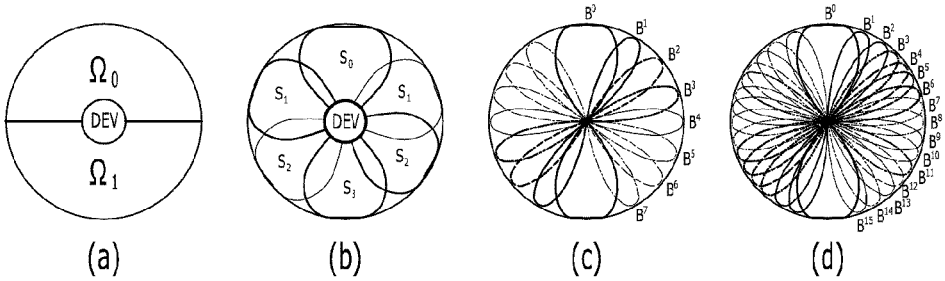

After the sector is decided, a beam level training procedure is performed as shown in FIG. 2B. In other words, a final beam signal pair is decided by performing beam level training with a further sharp beam at a corresponding sector. A beam resolution may be increased by additionally performing searching with a high resolution beam as shown in FIG. 2C. After performing all of the above procedures, a beam pattern is shown as shown in FIG. 2D.

According to the above beamforming protocol, a time for beam searching may be shortened a little in beamforming communication. However, it is still time consuming procedure. In accordance with an exemplary embodiment of the present invention, a beamforming antenna has a structure of FIG. 3 in order to find an optimized beam pair at a high speed.

Figure 3:
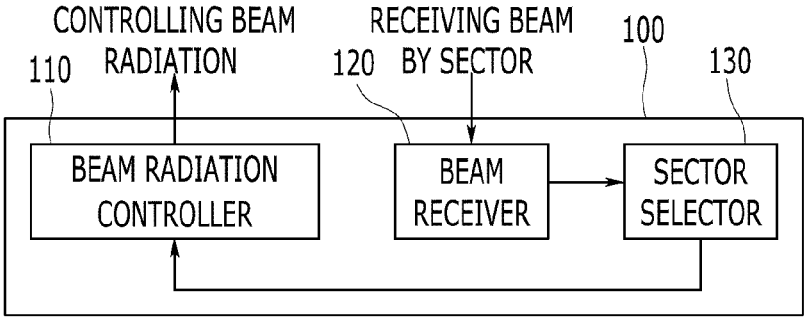
FIG. 3 illustrates a beamforming antenna control system in accordance with an exemplary embodiment of the present invention.

FIG. 3 illustrates a beamforming antenna control system in accordance with an exemplary embodiment of the present invention.

As shown in FIG. 3, a control system 100 of a beamforming antenna in accordance with an exemplary embodiment of the present invention may be connected to a plurality of beamforming antennas. The control system 100 may include a beam radiation controller 110, a beam receiver 120, and a sector selector 130.

The beam radiation controller 110 may control a beam to be radiated to a predetermined sector area for beam searching. Herein, an initially transmitted beam is controlled to be transmitted from signal transmitters in two antennas predetermined from the plurality of antennas. After the initially transmitted beam, beam radiation is controlled while increasing the number of antennas. Such a control operation will be described in later.

The beam receiver 120 of each antenna receives a response beam corresponding to the beam radiated to the predetermined sector area from the transmitter.

The sector selector 130 selects a sector related to a response beam having the strongest intensity among a plurality of the received response beams. The beam radiation controller 110 decides the selected sector as an optimized sector. The optimized sector may be a final sector according to the number of antennas. The sector selector 130 transfers information on the optimized sector to the beam radiation controller 110 in order to radiate a beam to the optimized sector.

A beam forming algorithm procedure performed through the control system will be described with reference to FIG. 4.

Figure 4:
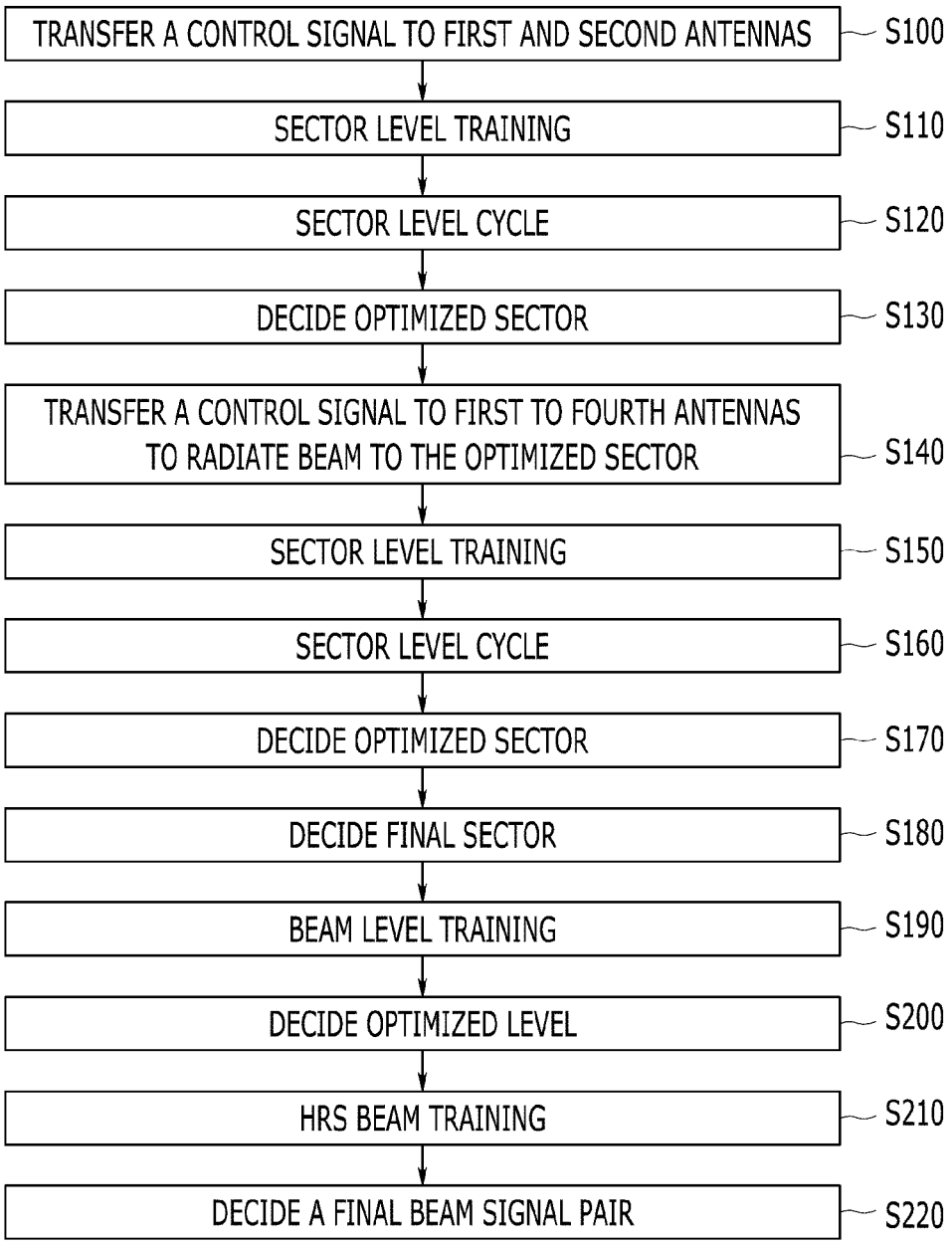
FIG. 4 is a flowchart that illustrates a beamforming algorithm procedure in accordance with an exemplary embodiment of the present invention.

FIG. 4 is a flowchart that illustrates a beamforming algorithm procedure in accordance with an exemplary embodiment of the present invention.

As shown in FIG. 4, a beamforming array antenna control system 100 transfers a control signal to two predetermined antennas in order to radiate a beam at step S100. In accordance with an exemplary embodiment of the present invention, the beamforming array antenna control system 100 will be described as being connected to eight array antennas 1 to 8 (N=8).

In order to search for a target when the system initiates, the two predetermined antennas radiating beams may be two center antennas, for example, a first antenna 1 and a second antenna 2, included in a predetermined first antenna group at step S100. Furthermore, each antenna radiates a beam to a predetermined sector at step S100. Herein, each antenna may be set up to radiate a beam to two sectors in accordance with an embodiment of the present invention.

After the first and second antennas 1 and 2 receive the control signal at step S100, the first and second antennas 1 and 2 perform sector level training that radiates signals to the predetermined two sectors, respectively at step S110. At this time, a third antenna 3 to an eighth antenna 8 do not operate. It will be described with reference to FIG. 5A to FIG. 5C.

Figure 5A:
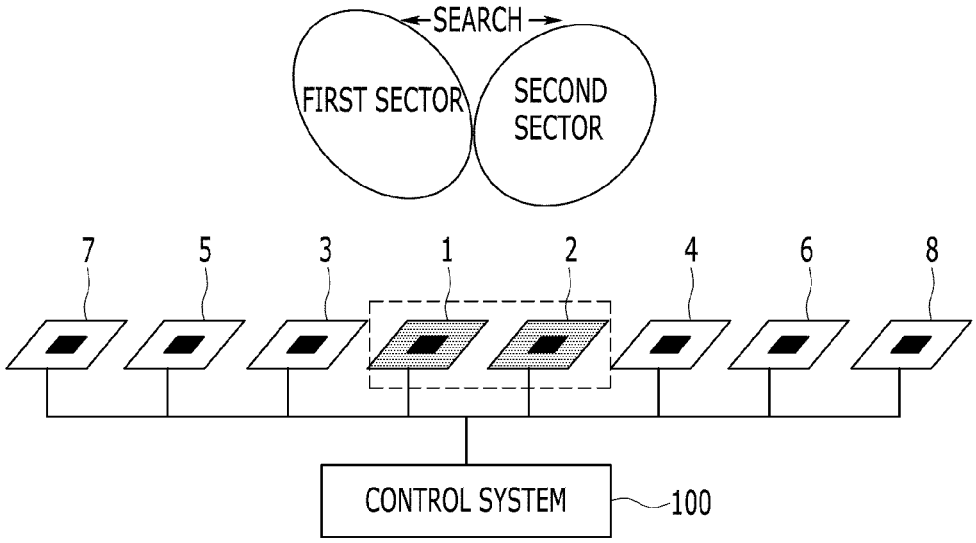
FIG. 5A to FIG. 5C illustrate a beamforming algorithm using a plurality of beamforming antenna, in accordance with an exemplary embodiment of the present invention.
Figure 5B:
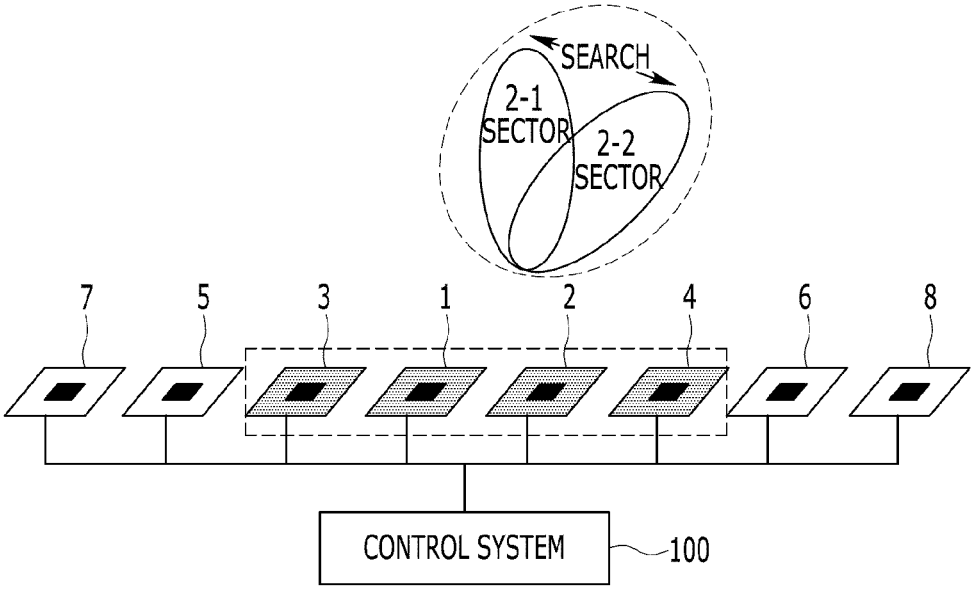
Figure 5C:
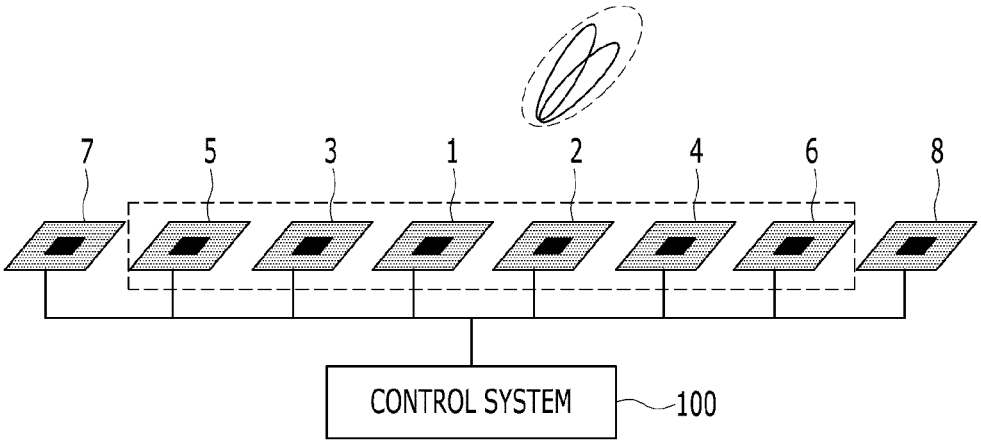

FIG. 5A to FIG. 5C illustrate a beamforming algorithm using a beamforming antenna in accordance with an exemplary embodiment of the present invention.

Referring to FIG. 5A, among eight beamforming antennas, first and second antennas radiate beams to two sectors. The first and second antennas may be two center antennas and included in a first antenna group. The two sectors may be a first sector and a second sector. The first and second antennas may radiate a comparatively wide beam as shown in FIG. 5A. The antenna group increases multiple of 2n (n denotes an positive integer). Up to N−2 (N denotes an positive integer) antennas may be used for sector level training.

As described above, the first antenna group receives response beams in response to the beam radiated at step S110 of FIG. 4. The first antenna group transfers a plurality of received response beams to a beam receiver 120 of the beamforming antenna control system 100. The plurality of received response beams may be response beams for the first and second sectors. Sector level cycle is performed using the transferred response beams S120. The beamforming antenna control system 100 determines that a search target exists in a sector related to a response beam having stronger intensity between the two response beams input to two antennas.

As shown in FIG. 5A, when a response beam input to the second sector has stronger intensity than that of a beam input to the first sector, the sector selector 130 selects the second sector as the optimized sector at step S130. The first antenna group and two antennas adjacent to the antennas of the first antenna group are set up as a second antenna group and the beam radiation controller 110 transmits a control signal to the second antenna group to radiate beams in a second sector direction at step S140 as shown in FIG. 5B. The two antennas adjacent to the antennas of the first antenna group may be a third antenna 3 and a fourth antenna 4.

When the second antenna group is set up based on the first antenna group, the number of antennas in the second antenna group is decided based on multiple of 2n of the first antenna group. That is, since the first antenna group includes the first antenna 1 and the second antenna 2, the second antenna group is set up to include four antennas such as the first antenna 1 to the fourth antenna 4.

Based on the control signal that was received at the step S140, the first to fourth antennas 1 to 4 perform sector level training that radiates beams in the second sector direction, for example, toward a 2-1 sector and a 2-2 sector at step S150. The second antenna group including the first to fourth antennas receives response beams corresponding to the radiated beams of S150 and transfers the received response beams to the signal receivers 120 of the beamforming antenna control system 100.

The beam receiver 120 transfers total eight response beams to the sector selector 130 to perform select level cycle at step S160. The sector selector 130 selects a sector related to a beam having the strongest beam intensity and decides the selected sector as the optimized sector at step S170.

As shown in FIG. 5B, when a response beam input to the 2-2 sector has stronger beam intensity than that of a response beam input to the 2-1 sector, the sector selector 130 selects the 2-2 sector as the optimized sector at step S170. The beamforming algorithm is described based on eight array antennas in accordance with an exemplary embodiment of the present invention. Since the number of antennas in the second antenna group radiating beams at the step S140 is four, six antennas may be required to set up a third antenna group. Since N−1 array antennas are used for beam level training and N array antennas are used for HRS training, steps S100 to S130 or steps S140 to S170 are performed again with the optimized sector selected in the step S170 to select a sector. The selected sector is decided as a final sector.

The sector selector 130 selects the optimized sector by repeating the above procedures. Since an output beam becomes a further sharp beam as the number of antennas radiating beams increases and since a sector area becomes more limited as the above procedures repeat, an optimized beam pair can be found at further faster speed. The sector area may be a beam search area.

The sector selector 130 decides the final sector at step S180 after repeating the steps S110 to S170. An optimized level is decided by performing beam level training through a seventh antenna 7 at steps S190 and S200. A beam to be transmitted to a target is decided by increasing a beam resolution while performing addition searching with a high resolution beam using an eighth antenna 8 at steps S210 and S220. Since the steps S190 to S230 of deciding the optimized level and performing additional searching with the high resolution beam are already widely known, detailed descriptions thereof will be omitted herein.

Figure 6:
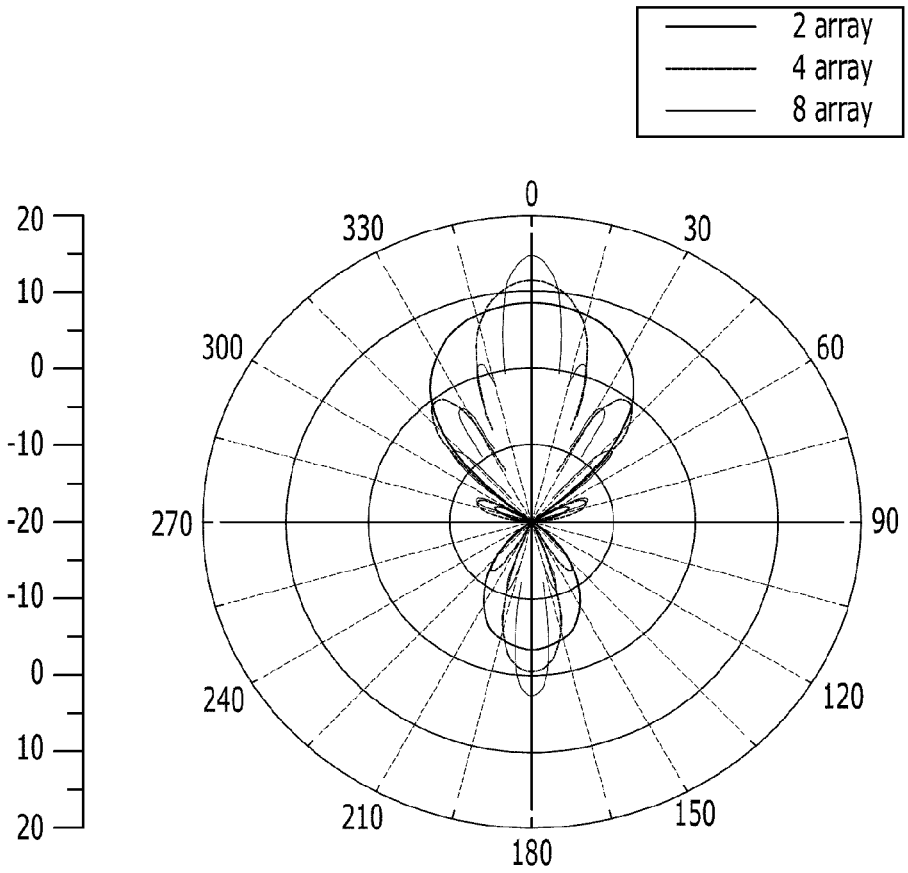
FIG. 6 illustrates a simulation result showing a beam width varying according to the number of antenna arrays, in accordance with an embodiment of the present invention.

FIG. 6 illustrates a simulation result showing a beam width varying according to the number of antenna arrays, in accordance with an embodiment of the present invention.

As illustrated in FIG. 6, the simulation result shows that a beam becomes sharp as the number of antenna arrays increases. Furthermore, the simulation result shows that efficiency becomes improved as the number of antenna arrays increases. Accordingly, sector training, level training, and high resolution beam training may be performed by controlling the number of operating antennas.

As described above, the beam width is changed according to the number of antennas. A radiation pattern of an antenna may be expressed as Equation 1 below.

$$\theta_h = \cos^{-1}\left[\frac{\lambda}{2\pi d}\left(-\beta \pm \frac{2.782}{N}\right)\right] \quad \text{(Equation 1)}$$

$$\Delta\theta_h = \left|\cos^{-1}\left[\frac{\lambda}{2\pi d}\left(-\beta - \frac{2.782}{N}\right)\right] - \cos^{-1}\left[\frac{\lambda}{2\pi d}\left(-\beta + \frac{2.782}{N}\right)\right]\right|$$

In Equation 1, λ denotes a wavelength, d denotes a gap between arrays, β denotes an input phase difference, and N denotes the number of arrays.

Based on Equation 1, a beam width ($\Delta\theta_h$) becomes narrower because a gap between beams becomes smaller as the number of arrays (N) is increased.

Accordingly, an array antenna system including a control system for controlling beamforming by being connected to a plurality of array antennas decides a sector through sector level training between a receiving antenna and a transmitting antenna when an array is a smallest array having the widest beam width, for example, 2-array. Herein, input signals of all antennas except the 2-array antenna become 0.

After deciding the sector, an optimized beam width is gradually reduced by performing beam level training while increasing the number of array antennas by multiple of 2n (n denotes an positive integer). In the same manner, input signals of all antennas become 0 except antennas related to the beam level training. In case of the antennas involved in the beam level training, a phase difference of the same input signal size is decided in order to control a beam to be radiated in a sector size.

An angle formed by beam can be calculated by equation that expresses an array factor. The array factor may be expressed by Equation 2 below.

$$AF = \sum_{n=1}^{N} e^{j(n-1)(kd\cos\theta)} = \sum_{n=1}^{N} e^{j(n-1)\Psi} = e^{j[(N-1/2)\Psi]}\left[\frac{\sin\left(\frac{N}{2}\Psi\right)}{\sin\left(\frac{1}{2}\Psi\right)}\right] \quad \text{(Equation 2)}$$

When Equation 2 is normalized by applying 0 as array center, Equation 2 can be converted to Equation 3 below.

$$AF = \left[\frac{\sin\left(\frac{N}{2}\Psi\right)}{N\sin\left(\frac{1}{2}\Psi\right)}\right] \simeq \left[\frac{\sin\left(\frac{N}{2}\Psi\right)}{\frac{N}{2}\Psi}\right] \quad \text{(Equation 3)}$$

A phase difference that maximizes the array factor may be decided when $\Psi$ becomes 0. It may be expressed by Equation 4 below.

$$\Psi = kd\cos\theta + \beta = 0, \beta = -kd\cos\theta$$

A beam may be controlled to be forward inside a sector size using the above equations with $\beta$ value obtained through simulations and measured value.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A control system for controlling beamforming by being connected to a plurality of array antennas, the control system comprising:

a beam radiation controller for requesting a predetermined first antenna group to radiate beams and requesting a second antenna group including the first antenna group to radiate beams to an optimized sector;

a beam receiver for receiving response beams from the first antenna group and the second antenna group; and a sector selector for setting up an optimized sector based on the received beams for the first antenna group, and transmitting information on the optimized sector to the beam radiation controller in order to control the second antenna group to radiate beams to the optimized sector.

2. The control system of claim 1, wherein the sector selector sets up a final sector based on response beams in response to a plurality of beams radiated to the setup optimized sector, and sets up a sector radiating a response beam having a comparatively stronger intensity among the plurality of response beams as the optimized sector or the final sector.

3. The control system of claim 1, wherein a number of antennas included in the second antenna group is decided as multiple of 2n of the first antenna group.

* * * * *